United States Patent [19]

Chulay

[11] 4,190,195

[45] Feb. 26, 1980

[54] HANGER DESIGN FOR A SWINGING CENTRIFUGE ROTOR

[75] Inventor: Steven J. Chulay, Los Altos, Calif.

[73] Assignee: Beckman Instruments, Inc., Fullerton, Calif.

[21] Appl. No.: 20,388

[22] Filed: Mar. 14, 1979

[51] Int. Cl.[2] ..... B04B 5/02

[52] U.S. Cl. ..... 233/26

[58] Field of Search ..... 233/26, 11, 1 R, 27

[56] References Cited

U.S. PATENT DOCUMENTS

| | | | |
|---|---|---|---|
| 3,393,864 | 7/1968 | Galasso et al. | 233/26 |
| 3,935,995 | 2/1976 | Williams et al. | 233/26 |

*Primary Examiner*—George H. Krizmanich
*Attorney, Agent, or Firm*—R. J. Steinmeyer; F. L. Mehlhoff; William H. May

[57] ABSTRACT

This invention relates to a swinging bucket centrifuge rotor in which each bucket is supported by an independent bucket hanger member disposed within a cavity in the rotor. Each hanger member is spring biased in a radial direction toward the axis of rotation, and is supported by a guide sleeve with fastening means extending through the guide sleeve. The guide sleeve prevents rotation of the bucket and hanger member with respect to the rotor body.

4 Claims, 6 Drawing Figures

HANGER DESIGN FOR A SWINGING CENTRIFUGE ROTOR

BACKGROUND OF THE INVENTION

This invention relates generally to a centrifuge apparatus and more particularly to ultracentrifuges which utilize high rotational speeds.

Swinging bucket type centrifuges include buckets, which contain the substance to be centrifuged and are supported from a rotor body by suitable supporting means. While the rotor is at rest, the bucket is generally hanging vertically downward from an appropriate bucket hanger member, and during acceleration and deceleration the buckets swing up to and down from a horizontal plane. They are restrained from outward radial movement under the high centrifugal forces by shoulder portions of the rotor which supports the buckets.

U.S. Pat. No. 3,393,864, Galasso et al., discloses a centrifuge assembly in which each bucket is supported by an independent bucket-hanger member which is spring biased toward the rotational axis of the rotor. This permits the bucket to seat in a cavity of the rotor during operation of the centrifuge. It has been discovered that under certain conditions it is possible for the rotor bucket and hanger member to twist or turn during operation. This can cause the bucket contents to mix when the centrifuge decelerates and the bucket returns to its vertical position.

U.S. Pat. No. 3,935,995, Williams et al., provides a spring biasing means similar to the means utilized by Galasso et al. The Williams arrangement also includes a bucket hanger which supports the centrifuge buckets, a compression spring and a screw which is secured in the body of the rotor. The hanger member is capable of movement in a radial direction of the rotor and is biased inwardly by the spring toward the axis of rotation of the rotor similarly as in the Galasso arrangement. The hanger member is designed to have a slidable fit within a recess formed in the rotor body itself. The hanger member is "generally square or rectangular" while the recess "also has a square or rectangular cross section to prevent the hanger from rotating about its path of movement" as it slides within the recess formed in the rotor.

SUMMARY OF THE INVENTION

The present invention is an improved hanger design for a swinging bucket centrifuge rotor including a biasing means adapted to seat swinging buckets of the rotor against shoulder portions of the respective cavities within the body of the rotor. Initial rotation of the centrifuge rotor causes the buckets to swing to a horizontal plane. As the centrifugal force of the rotating buckets increases, it overcomes the force of the biasing means and each bucket moves into engagement with a shoulder formed in the rotor body. The improved hanger design for each bucket comprises a non-circular recess formed in an interior wall of the cavity; an elongated guide sleeve having a non-circular cross section, with one end of the guide sleeve being disposed in the non-circular recess and confined therein against rotational movement by the cooperating non-circular shape of the guide sleeve and the recess; fastening means extending through the guide sleeve fastened to the rotor within the recess; a bucket hanger member mounted on the guide sleeve, the hanger member including a portion thereof conforming to and closely abutting the exterior surface of the non-circular guide sleeve; and spring means confined in an area defined by the interior of the hanger member and the exterior surface of the guide sleeve biasing the hanger in a direction toward the axis of rotation.

Because the exterior surface of the guide sleeve is non-circular and the recess in which the guide sleeve is secured is also non-circular, and because the bucket hanger member which slides on the sleeve includes a portion thereof conforming to the exterior shape of the guide sleeve, relative rotation cannot occur.

DESCRIPTION OF THE DRAWINGS

1.

2.

3.

4.

5.

6.

DESCRIPTION OF THE PREFERRED EMBODIMENTS

Figure 1:
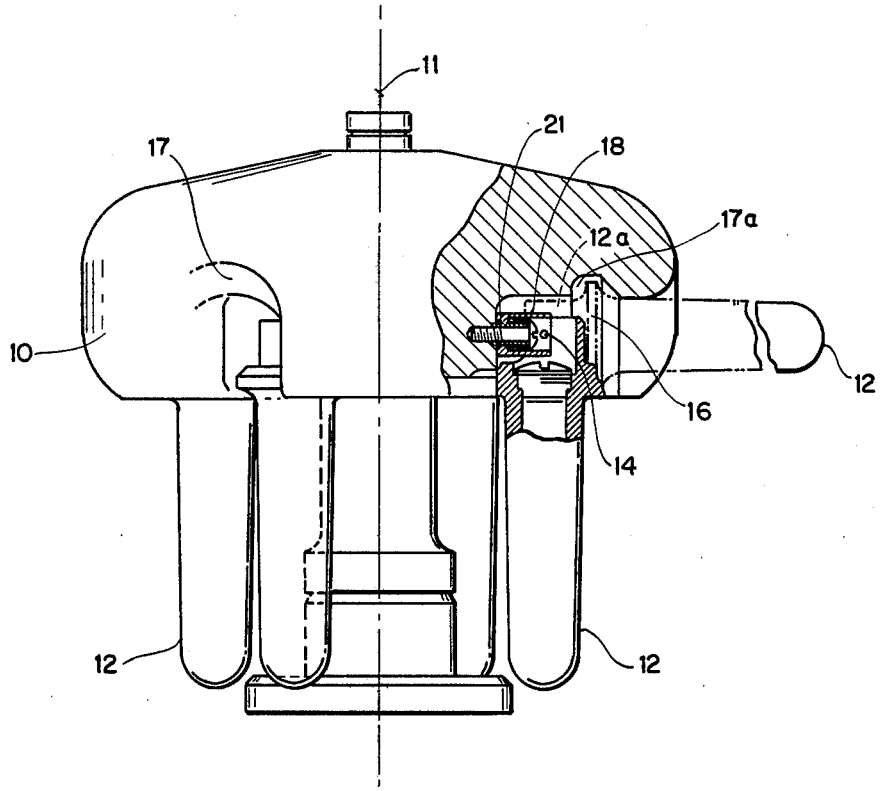
FIG. 1 is an elevational view of a swinging bucket rotor in accordance with the invention.
Figure 2:
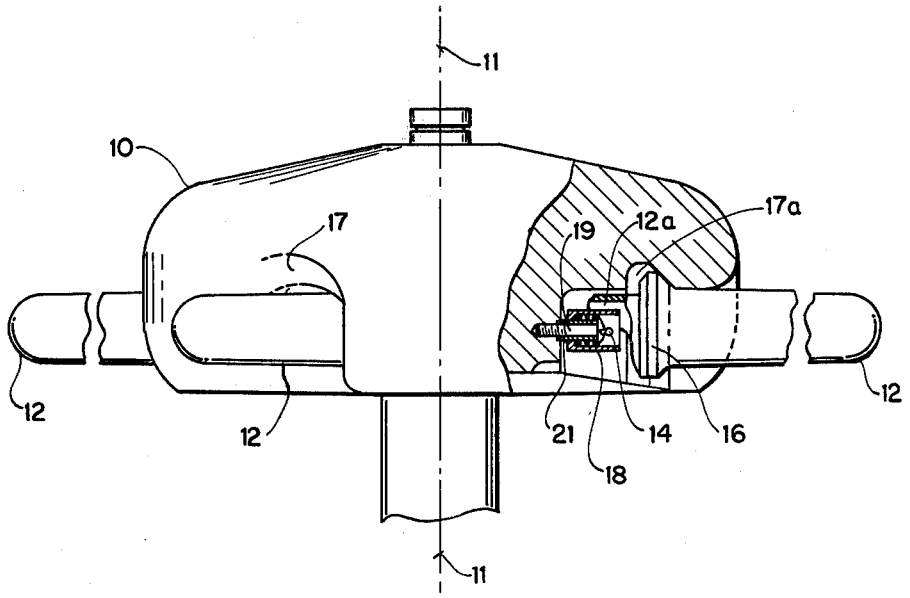
FIG. 2 is an elevational view of a swinging bucket rotor illustrating the position of a seated bucket when the rotor is rotating.

The centrifuge rotor 10 illustrated in FIG. 1 is driven by a motor (not shown) about a vertical axis 11. FIG. 1 illustrates the rotor in a rest position. Hanging from the rotor are a plurality of buckets 12 which contain the substance to be centrifuged. As shown in FIG. 2, buckets 12 include bucket extensions **12*a* with pin members 14. Cavities 17 of the rotor allow buckets to pivot into horizontal positions as shown by the dashed line in FIG. 1, and illustrated in FIG. 2, during rotation of rotor 10. Shoulder portions 17a of cavities 17 are formed in the body of rotor 10, allowing seat portions 16 of buckets 12 to properly seat within rotor 10 and to limit outward radial movement of buckets 12**.

Figure 3:
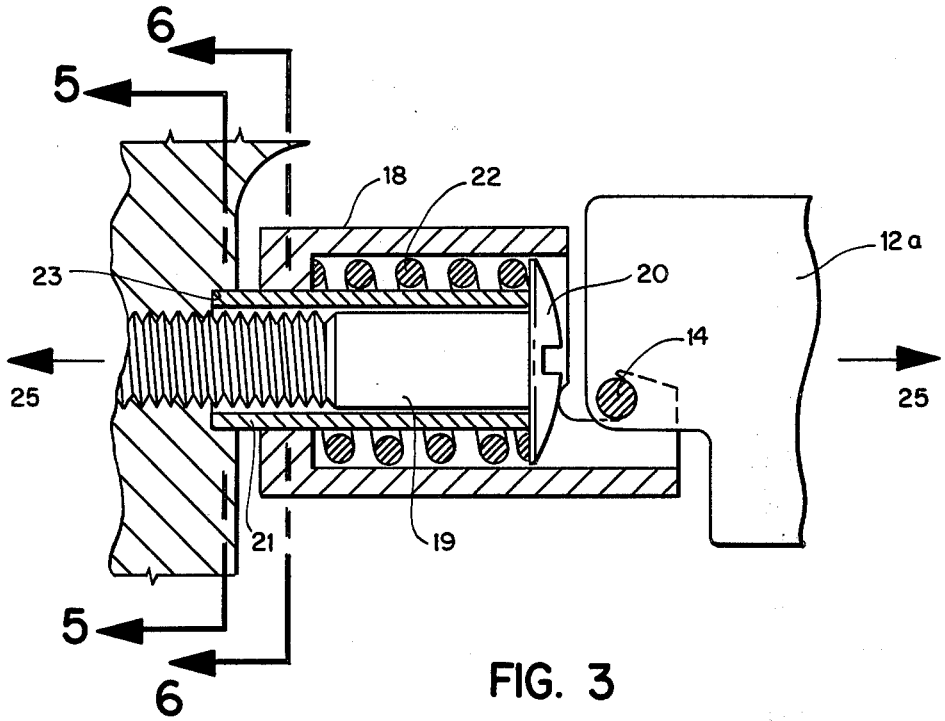
FIG. 3 is an enlarged fragmentary sectional view of a portion of FIG. 2 illustrating a first embodiment of the invention.
Figure 4:
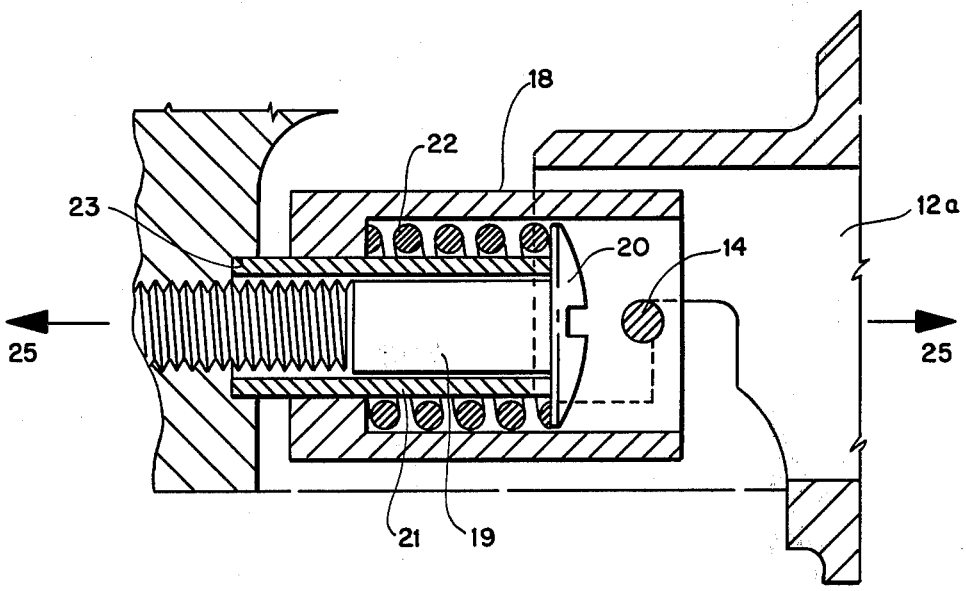
FIG. 4 is an enlarged fragmentary sectional view of a portion of FIG. 2 illustrating a second embodiment of the invention.

Referring now to FIG. 3, pins 14 are received in cross-drilled holes in bucket extensions 12a in a first embodiment of the invention. FIG. 4 illustrates a second embodiment of the invention, showing pin 14 received in a cross-drilled hole of hanger member 18.

Each cavity 17 is provided with a hanger device which includes fastener means 19, guide sleeve 21, hanger member 18, and spring means 22. Sleeve 21 surrounds fastener 19 and abuts flanged end 20. Spring 22 is situated around sleeve 21 and is confined within the interior of hanger member 18.

Each hanger member 18 is slidably mounted in rotor 10 by fastener 19 and guide sleeve 21 as illustrated in FIGS. 3 and 4. Each hanger member 18 supports a bucket 12 and is slidable in a radial direction with reference to vertical axis 11. Fastener 19 is preferably in the nature of a threaded screw or bolt member with a first end threaded and secured to the body of rotor 10, and a flanged second end 20.

During operation of the centrifuge, buckets 12 are filled with the substances to be centrifuged, capped and hung on hanger members 18. Rotation of rotor 10 swings buckets 12 from vertical positions to horizontal positions and the centrifugal force provided by the rotating buckets 12 begins to cancel the biasing force exerted radially inward by the spring 22 against hanger 18, allowing buckets 12 to seat against shoulder portion 17*a*. After sufficient centrifuging, the reverse occurs and buckets 12 return to vertical positions.

Sleeve 21 is mounted in recess 23 formed in rotor body 10 within cavity 17. The geometric configuration of aperture 23 is non-circular in shape, such as square or rectangular. The exterior surface of sleeve 21 is also non-circular and, in the preferred embodiments, conforms to the shape of recess 23. Cooperation between the respective non-circular shapes of recess 23 and sleeve 21 prevents rotational movement of sleeve 21 with respect to the longitudinal axis 25 of fastener 19. A portion of the hanger member 18 is slidably supported on sleeve 21, and is, in the preferred embodiment of the invention, of the same geometric configuration as the exterior surface of sleeve 21. In this manner, radial movement of hanger member 18 is guided along sleeve 21 and rotational movement with respect to axis 25 is prevented.

Figure 5:
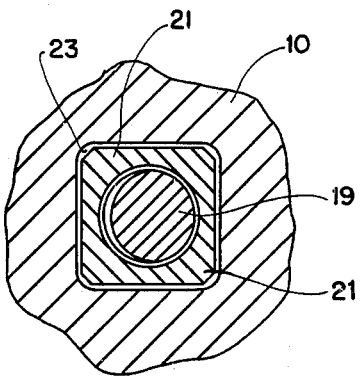
FIG. 5 is a cross-sectional view of FIG. 3 taken along the line 5—5.

FIG. 5 illustrates a cross-sectional view of rotor 10, recess 23, sleeve 21 and fastener 19, taken along the line 5—5 in FIG. 3. FIG. 5 shows the body of fastener 19 having a circular cross-sectional shape. The interior of sleeve 21 also has a circular cross-sectional shape. The exterior of sleeve 21 has an essentially square shape, and recess 23 also has an essentially square shape. The cross-sectional shapes of recess 23 and the exterior of sleeve 21 are non-circular to prevent rotational movement of sleeve 21 about axis 25. It will be understood that other non-circular shapes may be employed so long as the shape of the recess mates closely with that of the sleeve to prevent rotational movement of the sleeve about axis 25.

Figure 6:
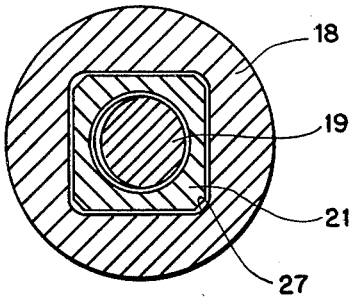
FIG. 6 is a cross-sectional view of FIG. 3 taken along the line 6—6.

FIG. 6 illustrates a cross-sectional view of fastener 19, sleeve 21 and hanger member 18, taken along the line 6—6 in FIG. 3. FIG. 6 shows fastener 19 and the interior of sleeve 21 both having circular cross-sectional shapes, the exterior of sleeve 21 having an essentially square shape, and the interior porton 27 of hanger member 18 engaged with the exterior of sleeve 21 also having an essentially square shape. It will be understood that other geometric shapes are possible, provided, however, that the exterior shape of sleeve 21 and interior abuting portion 27 of hanger member 18 are both non-circular, and that the interior abutting portion 27 of hanger member 18 is engaged with the exterior surface of sleeve 21 so as to preclude rotational movement of hanger member 18 about axis 25.

Sleeve 21 guides the radial movement of hanger member 18 so that bucket 12 is properly seated during operation of rotor 10. Should fastener 19 become loose at any time as a result of rotor vibration, the rotational movement of fastener 19 will not be transferred to sleeve 21 since sleeve 21 is nonrotatable within non-circular recess 23. Because the rotational movement of fastener 19 cannot be transferred to sleeve 21, sleeve 21 does not permit rotational movement from fastener 19 to be transferred to hanger member 18. By this construction, rotational movement of hanger member 18 and bucket 12 about axis 25 is prevented.

As is apparent, the specific embodiments described herein may be altered and changed by those skilled in the art without departing from the true spirit and scope of the invention which is described in the appended claims.

What is claimed is:

1. In a swinging bucket centrifuge rotor of the type having a plurality of peripheral cavities equally spaced about the axis of rotation of the rotor, each of the cavities having a hanger member mounted therein for pivotally supporting a bucket, the bucket adapted to pivot from a vertical position when the rotor is at rest to a horizontal position when the rotor is rotating, the hanger member being radially movable with respect to the axis of rotation, for each hanger member and cavity the improvement comprising:

a non-circular recess formed in an inner wall of the cavity;

an elongated guide sleeve having a non-circular cross section, one end of the guide sleeve being disposed in the non-circular recess and confined therein against rotational movement by the cooperating non-circular shape of the guide sleeve and the recess, the guide sleeve extending radially outward into the cavity;

fastening means extending through the guide sleeve, having one end fastened to the rotor within the recess;

the bucket hanger member being mounted on the guide sleeve, the hanger member including a portion thereof conforming to and closely abutting the exterior surface of the non-circular guide sleeve, thereby permitting the hanger member to slide radially on the guide sleeve but preventing rotation thereof; and spring means confined in an area defined by the interior of the hanger member and the exterior to the guide sleeve exerting a radial force on the hanger member in a direction toward the axis of rotation of the rotor.

2. The swinging bucket centrifuge rotor as defined in claim 1, wherein the non-circular recess and the exterior shape of the guide sleeve are essentially square.

3. The swinging bucket centrifuge as defined in claim 1, wherein the fastening means has a flanged end.

4. The swinging bucket centrifuge as defined in claim 1, wherein the fastening means comprises a threaded screw with a flanged end, the threaded end of the screw being fastened to the rotor.

* * * * *